US008555543B2

(12) United States Patent
Baldassano

(10) Patent No.: US 8,555,543 B2
(45) Date of Patent: Oct. 15, 2013

(54) SALT WATER KILL OF A SOFT TISSUE ORGANISM

(76) Inventor: Paul N. Baldassano, New Hyde Park, NY (US)

( * ) Notice: Subject to any disclaimer, the term of this patent is extended or adjusted under 35 U.S.C. 154(b) by 530 days.

(21) Appl. No.: 13/012,579

(22) Filed: Jan. 24, 2011

(65) Prior Publication Data

US 2012/0188680 A1 Jul. 26, 2012

(51) Int. Cl.
*A01K 79/02* (2006.01)

(52) U.S. Cl.
USPC ..... 43/17.1

(58) Field of Classification Search
USPC ..... 43/5, 6, 17.1
See application file for complete search history.

(56) References Cited

U.S. PATENT DOCUMENTS

| | | | | |
|---|---|---|---|---|
| 3,484,665 | A * | 12/1969 | Ormsby et al. | 361/232 |
| 3,998,459 | A * | 12/1976 | Henderson et al. | 463/47.3 |
| 4,667,431 | A | 5/1987 | Mendicino | |
| 4,839,980 | A | 6/1989 | Hersom | |
| 5,214,873 | A * | 6/1993 | Sharber | 43/17.1 |
| 5,732,501 | A | 3/1998 | Ausburn | |
| 6,197,168 | B1 | 3/2001 | Matsunaga et al. | |
| 6,547,952 | B1 | 4/2003 | Staerzl | |
| 6,804,909 | B1 * | 10/2004 | West | 43/17.1 |
| 7,174,668 | B2 | 2/2007 | Locklear | |
| 7,179,478 | B2 | 2/2007 | Gatto, Jr. | |
| 7,591,411 | B2 | 9/2009 | Jacobs | |
| 8,091,269 | B2 * | 1/2012 | Orchard | 43/17.1 |
| 2006/0168872 | A1 * | 8/2006 | Locklear | 43/17.1 |
| 2009/0025270 | A1 | 1/2009 | Orchard | |

FOREIGN PATENT DOCUMENTS

| | | |
|---|---|---|
| DE | 4441080 A1 | 4/1995 |
| WO | WO 96/37099 | 11/1996 |

OTHER PUBLICATIONS

Tropical Reef Corals, AipTaser Aquarium Pest Eradicator, Nov. 22, 2010, http://tropical reef corals.com.

* cited by examiner

*Primary Examiner* — Monica Williams
(74) *Attorney, Agent, or Firm* — Hoffmann & Baron LLP

(57) ABSTRACT

According to aspects described herein, there is disclosed an apparatus for killing a soft tissue organism in a salt water environment. The apparatus includes an elongate tubular housing, a probe and a conductive element. The elongate tubular housing reaches from outside a salt water environment to at least a portion of a soft tissue organism disposed within the salt water environment. The elongate tubular housing includes a proximal end and a distal end. The probe targets the soft tissue organism, The probe protrudes from the distal end of the housing, wherein the probe is exposed to the salt water environment when the distal end is submerged therein. The conductive element is rigidly supported by the housing between the distal end and the proximal end. The conductive element is exposed to the salt water environment when the housing distal end is submerged therein. The probe and the conductive element being operatively coupled to a source of electric current, such that the salt water environment provides a circuit coupling between the probe and the conductive element for killing the soft tissue organism.

14 Claims, 7 Drawing Sheets

SALT WATER KILL OF A SOFT TISSUE ORGANISM

TECHNICAL FIELD

The presently disclosed technologies are directed to killing and/or eradicating soft tissue organisms in a salt water environment. In particular, it is directed to an apparatus and method for eliminating anemone, more particularly *mojano* and *aiptasia* anemones, in salt water aquariums.

BACKGROUND

Salt water aquariums are often maintained in household or commercial environments for their aesthetics, as well as hobbyists, particularly those interested in maintaining a coral reef aquarium. One known problem with coral reef aquariums, which are typically salt water based, is a pest known as the anemone or sea anemone. Two species of sea anemone called *mojano* and *aiptasia* anemones grow profusely in captive reef aquariums and are known to harm and even kill other creatures maintained in the same salt water environment. These sea anemones sting other creatures that come in contact with them, which can be a particular problem when those creatures are rare and/or exotic sea creatures obtained specifically for the aquarium.

It is known in the industry that anemone are extremely difficult to eliminate from coral reef aquariums. Various techniques have been attempted including injecting boiling vinegar, boiling saline water or even utilizing certain other creatures to control their growth. However, combined with the fact that the anemone multiply very quickly, they have proven to be very resilient to these eradication techniques. For example, some of the techniques which involve injecting the anemone with a hypodermic needle containing toxins have yielded dubious results and even sometimes caused the creature to reproduce faster. Another difficulty in killing or eradicating these creatures is that if they are not eliminated quickly, they will spread spores that then later multiply into new anemone.

Accordingly, it would be desirable to provide an apparatus for and method of killing soft tissue organisms in a salt water environment that is effective, convenient, easy to use and overcomes other shortcomings of the prior art.

SUMMARY

According to aspects described herein, there is disclosed an apparatus for killing a soft tissue organism in a salt water environment. The apparatus includes an elongate tubular housing, a probe and a conductive element. The elongate tubular housing reaches from outside a salt water environment to at least a portion of a soft tissue organism disposed within the salt water environment. The elongate tubular housing includes a proximal end and a distal end. The probe targets the soft tissue organism, The probe protrudes from the distal end of the housing, wherein the probe is exposed to the salt water environment when the distal end is submerged therein. The conductive element is rigidly supported by the housing between the distal end and the proximal end. The conductive element is exposed to the salt water environment when the housing distal end is submerged therein. The probe and the conductive element being operatively coupled to a source of electric current, such that the salt water environment provides a circuit coupling between the probe and the conductive element for killing the soft tissue organism.

According to further aspects of the disclosed technologies, the apparatus can include a switch controlling the electric current. The switch can be disposed closer to the housing proximal end than the housing distal end. The conductive element can be a graphite rod. Alternatively, the conductive element can be a hollow tube through which a wire can pass. The conductive element can be operatively coupled to the source of electric current by way of a coil element joining the conductive element to an electrical wire. The conductive element can be spaced away from the probe toward the housing proximal end. The elongate tubular housing substantially resists deformation from a weight of a distal portion of the apparatus when held at a proximal portion of the apparatus as the primary support for the distal portion, the apparatus distal portion corresponding to the housing distal end and the apparatus proximal portion corresponding to the housing proximal end. At least a portion of the conductive element can be surrounded by the housing. The conductive element can be an elongate rod having a lengthwise longitudinal extent, at two opposed ends of the longitudinal extend the conductive element being surrounded by the housing, an intermediate portion of the conductive element being exposed to the salt water environment. The conductive element can be at least partially contained within a secondary structure secured to and protruding laterally from the housing. The conductive element can protrude outwardly from the secondary housing and into a tertiary housing secured to and protruding laterally from the housing. The conductive element can also be disposed within a portion of the elongate tubular housing, the elongate tubular housing including apertures immediately adjacent the conductive element thereby exposing the conductive element to the salt water environment when the distal portion is submerged therein. The conductive element can include a hollow inner portion through which a wire passes for coupling the source of electric current with the probe. The portion of the elongate tubular housing in which the conductive element is disposed can bulge wider than the substantial extent of the tubular housing. Also, a substantial extend of the elongate tubular housing can be straight and a portion of the distal end of the elongate tubular housing can include a bend for precisely positioning the probe in the salt water environment. The bend can be disposed along the length of the elongate tubular housing between the conductive element and the probe.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
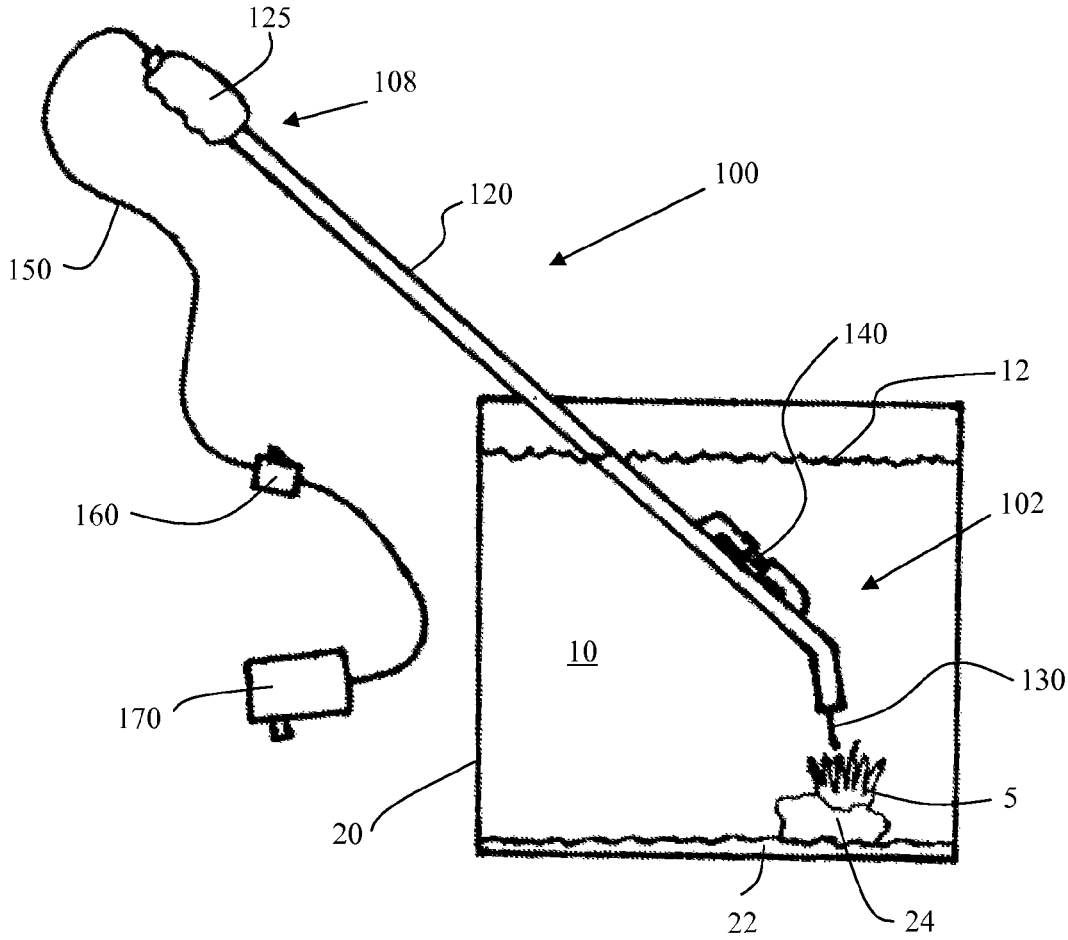
FIG. 1 is a side elevation view of an apparatus for killing a soft tissue organism in a salt water tank in accordance with aspects of the disclosed technologies.

Describing now in further detail these exemplary embodiments with reference to the Figures. The presently disclosed technologies include an apparatus for and method of killing soft tissue organisms in a salt water environment. As used herein the term "kill" or "killing" refers to causing the death of, putting to death or otherwise depriving a creature of life. To kill or killing a soft tissue organism includes destroying, nullifying, neutralizing, or even depriving the organism of vitality. Such killing is often done for the purpose of eradicating an unwanted soft tissue organism and preventing it from returning or reproducing in a particular area or environment. A "soft tissue organism" particularly in a salt water environment as referred to herein refers particularly to living organisms. Such soft tissue organisms particularly include sea anemones and other cnidarians. Otherwise a soft tissue organism can also include various other organized living creatures, including plants, animals, bacterium and others.

The apparatus includes an elongate tubular housing for reaching into a salt water environment from outside that environment in order to reach a target soft tissue organism disposed in the water. The tubular housing is held at a proximal end outside the salt water environment with a distal end of the tubular housing inside the salt water environment. In this way, a probe for targeting the soft tissue organism which is disposed at the distal end of the housing can be placed in the immediate proximity of the soft tissue organism or even in direct contact with the soft tissue organism. Additionally, a conductive element usually supported by the housing also gets exposed to the salt water environment when the distal end is submerged. Using available electric current coupled with a switch to two wires leading to the probe and conductive element respectively. With the negative wire connected to the stainless steel probe and a positive wire connected to the conductive element. In this way, when a switch is closed allowing the voltage to flow through the wires, the salt water environment causes a circuit coupling the probe and the conductive element for killing the soft tissue organism. In a preferred embodiment, the conductive element includes a graphite rod which is directly coupled to the positive copper wire and the stainless steel probe is directly coupled to the negative copper wire. When the circuit is closed allowing current to flow, an electrochemical reaction occurs in close proximity to the probe which releases chlorine and hydrogen gas. In this way, by placing the probe in contact with or at least in close proximity to the soft tissue organism, the combination of gasses and electricity will harm and preferably kill the soft tissue organism. In the case of an anemone, the combination of gas and electricity will disintegrate the creature. Also, because the gasses are only generated in significant concentrations in the immediate vicinity of the probe, other animals and creatures in the immediate vicinity are not affected by this localized toxic environment.

FIG. 1 shows an apparatus 100 for killing a soft tissue organism 5 within a salt water environment 10. The salt water environment 10 can be held within a container 20, in the form of an aquarium, tank or other vessel. Generally such a container 20 is filled with a bed 22 of gravel and ornamental elements 24, such as coral or other objects. A typical aquarium uses a salt water environment of water and sea salts to maintain both coral and soft tissue organisms, typically salt water fish. The tank 20, shown in FIG. 1 has an open top configuration, but the opening in the top can be only partial, as well as temporary for accessing the inside. In this way, the soft tissue organism killing apparatus 100 is inserted into the top of the tank, past the water surface 12 and into the salt water environment 10. A target soft tissue organism 5 is shown growing on the ornamental element 24, which is most typically a piece of coral. The probe tip of the apparatus 100 is shown being placed immediately adjacent to the soft tissue organism, which is shown as an anemone. The apparatus 100 works to kill soft tissue organisms by placing the probe 130 in contact with or at least in the immediate proximity to a soft tissue organism.

A distal end 102 of the apparatus 100 includes a probe 130 for targeting the soft tissue organism 5 as well as a conductive element 140 that works in conjunction with the probe 130. The apparatus 100 can also include wires 150 for transmitting current supplied by a power supply 170 and regulated by an intermediate switch 160. The wires 150 are coupled to the probe 130 and conductive element 140 as described further below.

A proximal end 108 of the apparatus 100 is coincident with the housing proximal end and is generally held by a user, preferably outside the salt water environment. In the embodiment shown, a handle 125 is included, although it should be understood that a different handle can be provided or no handle need be provided at all. With or without a handle 125, to target a soft tissue organism within an aquarium, the user holds the proximal end 108 of the tubular housing 120 and places the distal end 102 in close proximity with the creature.

The tubular housing 120 should be long enough to extend from outside a typical aquarium tank to the bottom thereof. Thus, the length of the apparatus 100 can be made shorter or longer depending on the intended use. Also, the tubular housing 120 should be strong enough to hold its own weight, including the internal components, when held from the handle only and extending horizontally. For example, the housing can be made of Plexiglas, glass, acrylic or various individual or composite polymers. In a preferred embodiment the housing 120 is a rigid polymer tube that is not intended to substantially deflect or bend. Alternatively, the housing 120 can be semi-flexible or even selectively deformable, but still substantially hold its own shape. Such a selectively deformable housing could be bent and curved by a user as desired to reach places in the tank that would be difficult with just a straight or at least fully rigid housing.

Figure 2A:
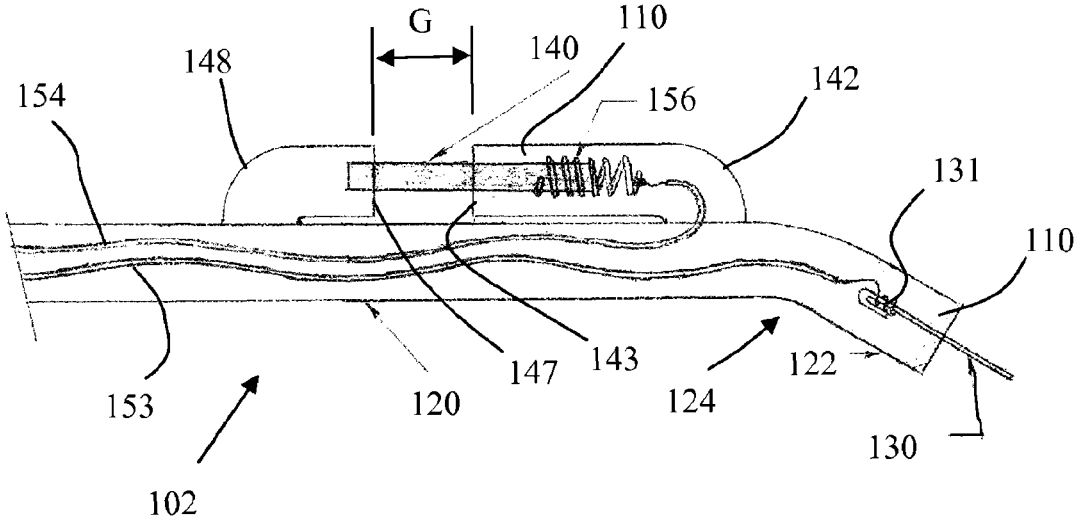
FIG. 2*a* is a side elevation view of the distal portion of the apparatus of FIG. 1.

FIG. 2*a* shows the distal end 102 of the apparatus 100, apart from the soft tissue organism. As shown, the housing 120 contains two wires 153, 154, which are part of the combined wires 150 that come from the proximal end 108. One wire 153 preferably carries the negative side of the current and is connected to the probe 130. Preferably, the probe is formed from an anti-corrosive conductive material, such as stainless steel, to resist the corrosive effects of the salt water environment. The wire 153 is secured to one end 131 of the probe, for example by twisting the wire around a curved portion of the probe or alternatively bonding the two elements 130, 153 together. The opposed end of the probe 130 extends outside the housing 120 for targeting the soft tissue organisms. Also, the tip of the housing 122 is sealed to prevent salt water from getting inside the housing. In the embodiment shown, the housing tip 122 is filled with a sealing resin 110, such as hot-melt glue, thus protecting the wires 153, 154 and any other elements inside the housing 120. Alternatively, a more easily removable cap could be used, through which the probe 130 would protrude. Regardless of how the housing tip 122 is sealed, consideration should be given for preventing salt water from entering the housing through any aperture, such as the tip. On consideration in this regard is that using wires 153, 154 or even the combined wiring 150 that include a round outer cross-section tends to seal more securely and prevent leaks better than flat or other non-round cross-section wires.

The distal end 102 of the housing 120 also can include a bend 124, which assists in targeting around obstructions within a tank. The bend could be made smaller or greater than that shown. Alternatively, the entire housing could be made straight, without such a bend. Or as a further alternative, the bend can be placed at a different location along the housing length, such as the proximal side of the conductive element 140.

The conductive element 140 can also be disposed at the distal end 102 of the apparatus 100. Although, it should be understood that the conductive element 140 could also be disposed further toward the proximal end 108. However, consideration should be given for making it easy to ensure that the conductive element 140 remains within the salt water environment when the probe 130 is actively being applied to kill soft tissue organisms. As referred to herein, the term "conductive element" means an element with a generally high electrical conductivity, such that electricity passes through the element well. Examples of conductive elements are metals and particularly graphite, which is an electrically conductive allotropic form of carbon. Further tubing super-structures 142, 148 are provided on a side of the housing 120. As shown, a significant portion of the tubing super-structures 142, 148 can extend parallel to the larger main housing tube. One wire 154 preferably carries the positive side of the current and is connected to the conductive element 140, which is at least partially disposed within both of the tubing super-structures 142, 148. As the wire 154 only needs to be attached to one end of the conductive element 140, it can extend from the larger main housing tube, through a side aperture leading into one portion one of the tubing super-structures 142 and then be secured to the conductive element 140.

In one embodiment, the conductive element 140 is a graphite rod that is connected to the wire 154 by a conductive coil 156, made of steel or even stainless steel. The conductive coil 156 is secured to the graphite rod by friction fit, being screwed onto one end of the graphite rod or even bonding the two elements 140, 154. Using a steel coil 156, advantageously can be secured easily to both the wire 154 and the graphite rod 140. Alternatively, the wire 154 could be secured directly on the conductive element 140 or secured by other means.

The conductive element 140 needs to be exposed to the salt water environment. Thus, one aspect of the disclosed embodiments has the conductive element extending between two tubing super-structures 142, 148 and crossing a gap G there between. The gap G only needs to be large enough to expose the conductive element to the salt water environment. Thus, the gap G could be made larger or smaller, as long as it the gap allowed the conductive element to provided the appropriate level of conductivity. At least a portion of the conductive element 140 is thus surrounded by a first tubing superstructure 142 and fixedly secured therein. It should be noted that as the main housing is also tubular, the first tubing superstructure 142 can be considered a secondary housing. The conductive element 140 can be secured by sealing resin 110, which provides the added benefit of sealing an open end 143 of the first tubing superstructure 142. The opposite end of the tubing superstructure 142 is preferably made as a continuous extension of the housing 120, so no sealing is necessary. Thus, filling the open end of the first tubing super-structure 142 with a sealing resin 110 can also protect the conductive coil 156 and wire 154 that is secured thereto.

As graphite is brittle, a second tubing super-structure 148 can be provided to protect, from damaging contact, the end of the graphite rod opposite from where the wire 154 is secured. It should be understood that as the main housing is also tubular the second tubing super structure 148 can be considered a tertiary housing. Thus, the conductive element 140 can also be at least partially surrounded by the second tubing super-structure 148. The conductive element 140 can be secured within the second tubing super-structure 148 with sealing resin filling the open end 147. Alternatively, the conductive element 140 can just partially extend into the second tubing super-structure 148 without being secured therein. The second tubing super-structure 148 need not be sealed as long as the end, where it attaches to the main housing 120, does not include an aperture into the main housing 120.

Figure 2B:
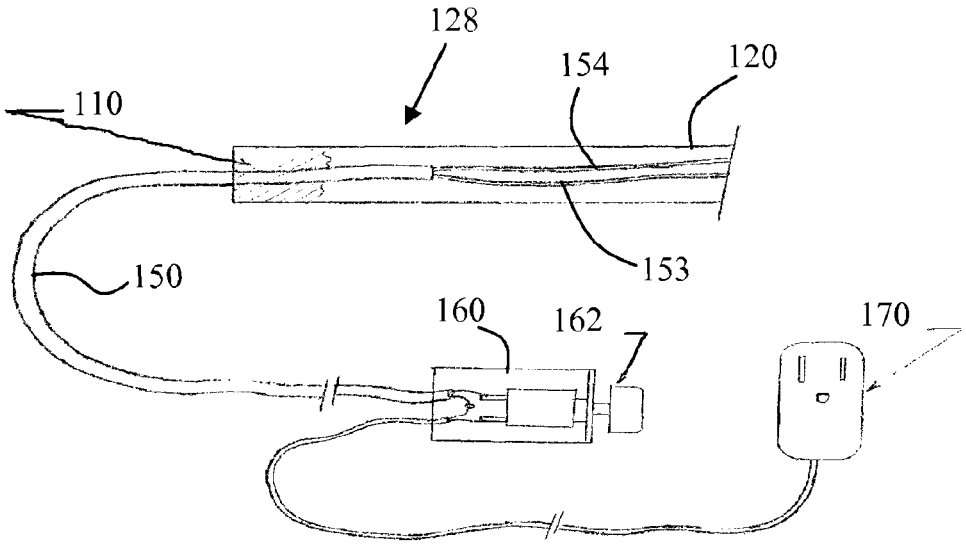
FIG. 2*b* is a side elevation view of the proximal portion of the apparatus of FIG. 1.

FIG. 2*b* shows the proximal end 108 of the apparatus 100, including the housing proximal end 128, the combined wires 150, a switch 160 and a power supply 170. The wires 150 extend from the housing proximal end 128 and a sealing resin 110 can be used to close-off this end of the housing 120. The wire 150 extends to the power supply 170, which in the illustrative example is a 12 volt DC 500 ma converter that gets plugged into a U.S. standard 110 volt electrical outlet. It should be understood that an alternative power supply could be used. From the power supply 170 the wires 150 lead into the housing and are operatively coupled to both the probe 130 and the conductive element 140. Disposed somewhere in that circuit is a switch 160, which can be used to open and close the circuit, thus turning the device off and on respectively once power is supplied. The embodiment shown in FIG. 2*b* shows a button 162, which when depressed closes the circuit and allows current to flow through the apparatus. The button 162 can be biased to move outwardly, thus opening the circuit when the user lets go, like a dead-man's switch. The button 162 could be an SPST momentary contact N/O push button, which is known in the art.

Figure 3A:
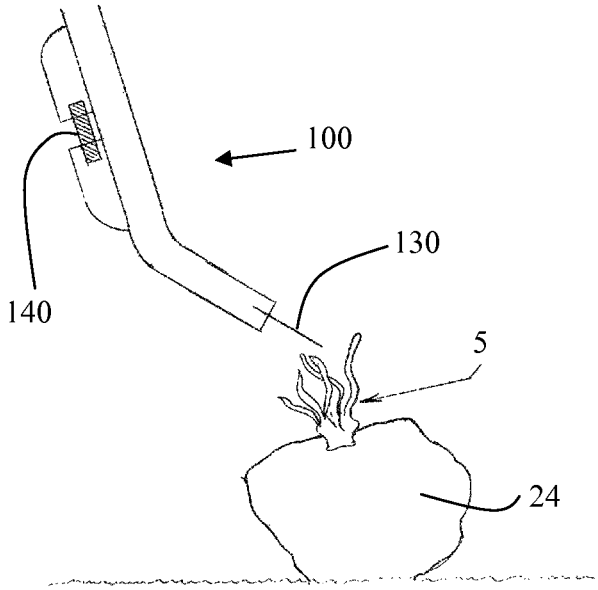
FIG. 3*a* is a side view of the apparatus of FIG. 1 in proximity with an anemone in a salt water environment.
Figure 3B:
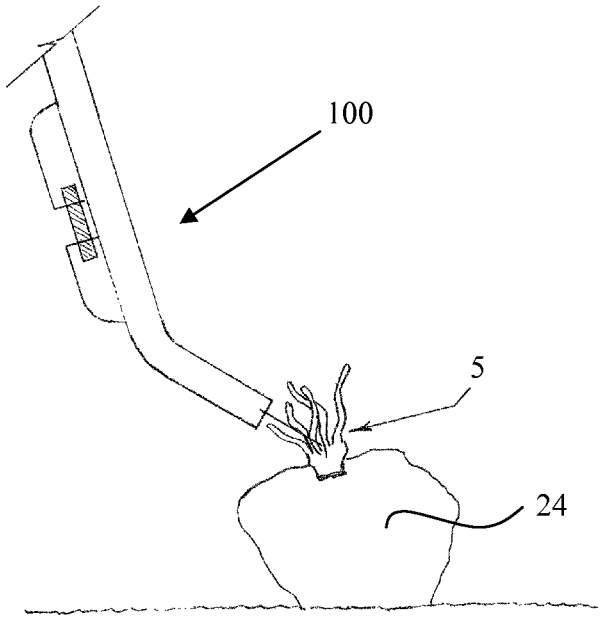
FIG. 3*b* is a side view of the apparatus of FIG. 1 in contact with an anemone in a salt water environment.

FIGS. 3*a* and 3*b* show the apparatus 100 being brought in close proximity to and then in contact with a soft tissue organism 5, respectively. In these configurations, with power supplied and the switch 160 closed (i.e., the power turned "on"), a combination of chlorine and hydrogen gas can form around the tip of the probe 130, which will kill many soft tissue organisms, but will particularly kill anemone. The apparatus 100 has been demonstrated to be more effective when the probe 130 is brought in direct contact with the soft tissue organisms 5. The contact with the organism 5 while the apparatus 100 is powered extends the chemical reactions to the creature itself, turning it white and having it wither immediately.

Figure 4A:
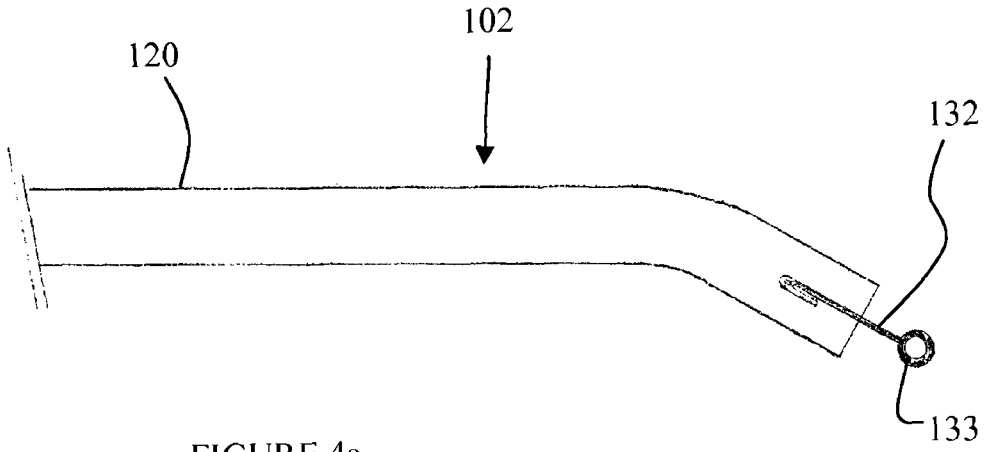
FIG. 4*a* is a side elevation view of an alternative distal portion of the apparatus including a different probe element in accordance with aspects of the disclosed technology.
Figure 4B:
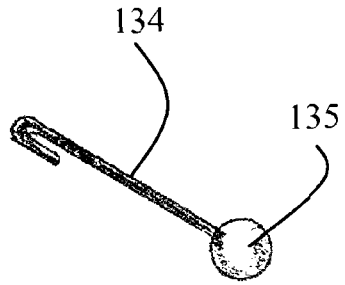
FIG. 4*b* is a side elevation view of a further alternative probe element in accordance with aspects of the disclosed technologies.
Figure 4C:
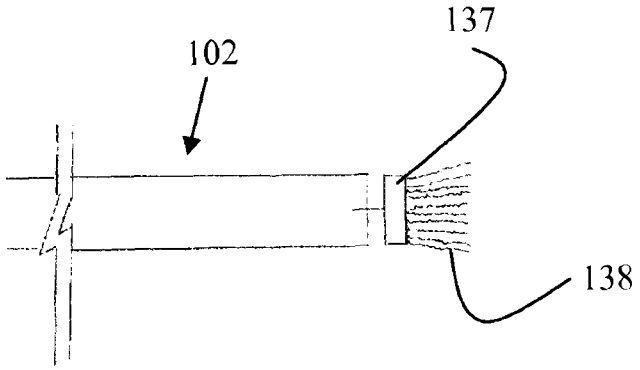
FIG. 4*c* is a side elevation view of a further alternative distal portion of the apparatus including yet a further different probe element in accordance with aspects of the disclosed technologies.

FIGS. 4*a*, 4*b* and 4*c* show alternative probes 132, 134, 137. FIG. 4*a* shows a ring probe 132, that includes a circular open ring 133 at the end of the metal rod of previous embodiments. By providing a larger probe tip 133, it can be easier to contact target soft tissue organisms. FIG. 4*b* shows a ball probe 134 that includes a sphere at the end of the probe, disposed similarly to the ring probe 132. Also, as yet a further alternative, FIG. 4*c* includes a wire brush probe 137 that includes a group of stainless steel wires 138 protruding from the end thereof. The stainless steel brush bristles 138 should be operatively connected to the wire 153 in order to conduct current like with the other probes.

Figure 5:
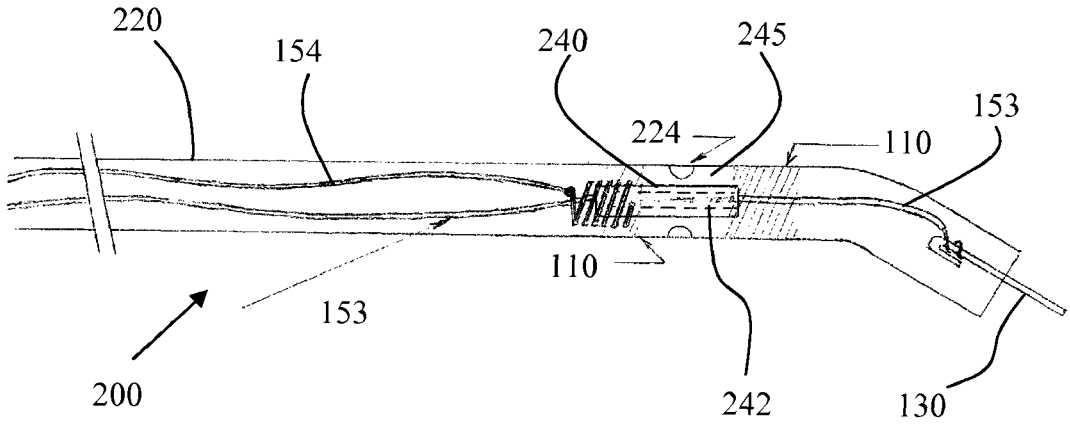
FIG. 5 is a side elevation view of the distal portion of the apparatus in accordance with alternative aspects of the disclosed technologies.

FIG. 5 shows an alternative apparatus 200 that includes a different housing 220, which configures the modified conductive element 240 differently. This embodiment eliminates the super structure tubing and embeds the conductive element 240 within the tubing of the main housing 220. In order to expose the conductive element 240 to the salt water environment one or more apertures 224 are provided in the main housing 220. The housing apertures 224 are immediately adjacent the conductive element 240 in order to allow the salt water to seep-in and contact the conductive element. It should be understood that the apertures 224 could be made larger or smaller. Also, the number, cross-sectional shape and location of apertures 224 can be arranged in any number of ways. In this embodiment, opposite ends of the conductive member 240 should be surrounded with sealing resin 110, filling-in the space between the conductive member 240 and the inner walls of the housing 220. The resin 110 thus resists or prevents salt water from entering other portions of the housing 220. In this way, one or more small chambers 245 get created just inside the apertures 224 and surrounding at least a central portion of the conductive element 240. The conductive member chamber 245 is sealed at opposed ends with resin 110. Additionally, although this alternative conductive element 240 is secured to the wire 153 by a coil, the other wire 154 passes through an inner passage 242 extending longitudinally through the conductive element 240. The conductive member 240 can be formed as a hollow tube, thus providing the inner passage 242 extending along its longitudinal extent. In this way, the first wire 153 can extend through the conductive element 240, past the chamber 245 and to the probe without a gap or space that could potentially causing a leak into the housing. This configuration of running the wire 153 through the conductive element 240 is an alternative to simply running the wire 153 alongside the outside of conductive element 240, the later option being prone to creating resin gaps that will compromise the housing seal.

Figure 6:
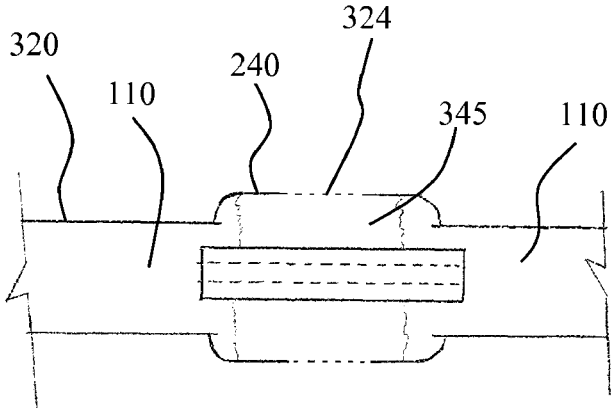
FIG. 6 is a side elevation view of a portion of the apparatus including the conductive elements in accordance with further alternative aspects of the disclosed technologies.

FIG. 6 shows yet a further alternative configuration for the conductive element 240 that is similar to that of FIG. 5. In this embodiment, the housing 320 includes a bulbous conductive element chamber 345, which is sealed at opposed ends with resin 110 after the wires are installed (wires and/or coil not shown). The larger chamber 345 includes apertures 324 for allowing the conductive element 240 to be exposed to greater amounts of the salt water.

Figure 7:
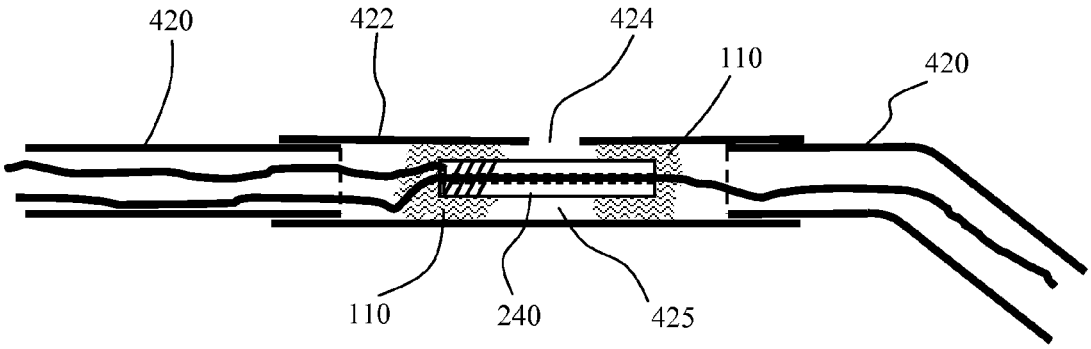
FIG. 7 is a side elevation view of a portion of the apparatus including the conductive elements in accordance with yet further alternative aspects of the disclosed technologies.
Figure 8:
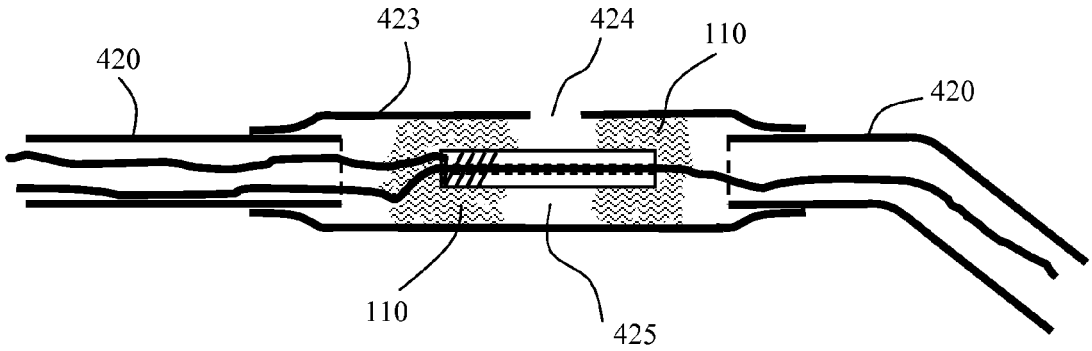
FIG. 8 is a side elevation view of a portion of the apparatus including the conductive elements in accordance with still further alternative aspects of the disclosed technologies.
Figure 9:
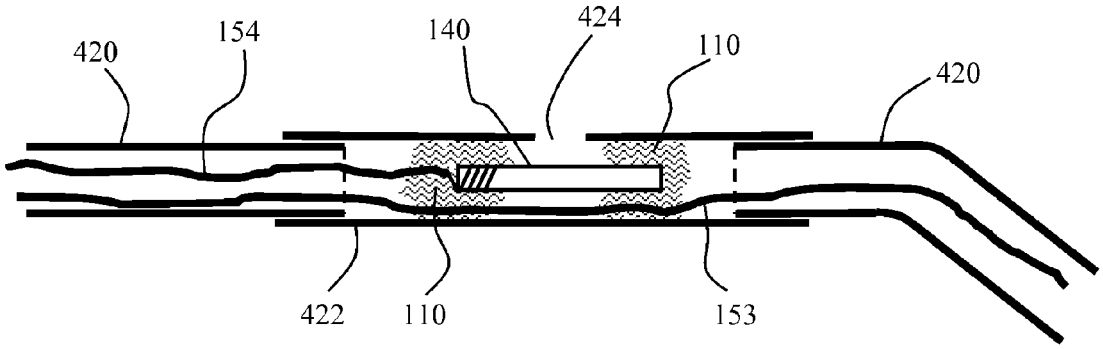
FIG. 9 is a side elevation view of a portion of the apparatus including the conductive elements in accordance with alternative aspects of the disclosed technologies.

FIGS. 7-9 show three similar further alternative embodiments that also eliminate the super-structure tubing included in the first embodiment. In these embodiments, an intermediate conductive element tube 422, 423 connects the two otherwise separated portions of the main housing tube 420. The intermediate conductive element tube 422, 423 is secured to the main housing 420 by gluing, melting or other known temporary or permanent means. These embodiments facilitate the construction of the apparatus and particularly the portion that houses the conductive element 140, 240, by allowing it to be assembled separately and easily assembling the whole apparatus. In particular, the conductive element 140, 240 is placed centrally within the tube 422, 423, already connected to its wire 154 and coil and secured in-place with the hot melt glue sealant 110. Even the probe wire 153 should be configured to pass through this part of the assembly. In FIGS. 7 and 8, the probe wire 153 passes through the hollow inner passage through the conductive element, whereas FIG. 9 includes a solid conductive element 140 that requires the wire 153 to pass along side it. It should be noted that the embodiment shown in FIG. 9 is more prone to leaks around the wire 153. Thus, care should be taken or additional means of sealing the housing should be employed for the later embodiment to avoid such leakage into the main portions of the housing 420. Any leaks will likely cause corrosion.

Figure 10:
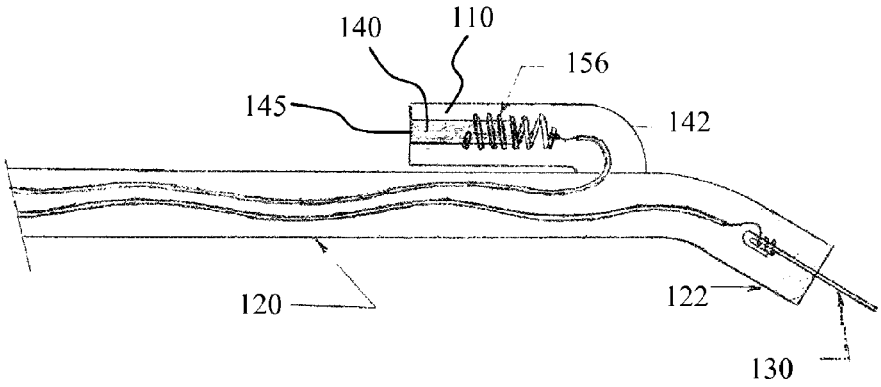
FIG. 10 is a side elevation view of a portion of the apparatus including the conductive elements in accordance with alternative aspects of the disclosed technologies.

FIG. 10 shows a further alternative embodiment similar to that of the embodiment shown in FIG. 2*a*. This embodiment eliminates the second tubing super-structure and shortens the conductive element 140. The first tubing super-structure 142 is included and the open end 143 sealed with resin 110, but an exposed tip 145 of the conductive element 140 is preferably exposed to the salt water environment. It should be noted that just having the axial end of a graphite rod exposed to the salt water environment may not be enough to create an effective surface area to cause the appropriate chemical reactions. Accordingly, as a further alternative to this embodiment, the resin can be set back from the open end of the tubular super-structure 142. In this way, while the resin seals around the coil, a portion of the lateral sides of the graphite rod 140, immediately adjacent the exposed tip 145, remain exposed to the salt water while still being surrounded by the tubular super-structure 142. In this further alternative configuration, the graphite rod, which is otherwise particularly fragile, can remain protected. As yet a further alternative, the open end of the tubular super-structure 142 can extend further away from the coil or where the wire attaches than the end tip 145 of the conductive element 140.

Additional features and elements could be added to the apparatus as disclosed herein. For example, if wiring cable 150, shown in FIG. 1, included more than two wires within, the additional wires could be used to power a light or possibly an additional probe. Also, other elements could be included to help retrieve the killed anemone after application of the apparatus as described herein. Such further elements could include prongs for grabbing the organisms or parts thereof after it is killed. Alternatively, the apparatus disclosed herein can include or be used in conjunction with a vacuum-type device that can suction away the killed organisms.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims, as originally presented and as they may be amended, encompass variations, alternatives, modifications, improvements, equivalents, and substantial equivalents of the embodiments and teachings disclosed herein and those that are presently unforeseen or unappreciated, and that, for example, may arise from applicants/patentees and others.

What is claimed is:

1. An apparatus for killing a soft tissue organism in a salt water environment, the apparatus comprising:

an elongate tubular housing for reaching from outside a salt water environment to at least a portion of a soft tissue organism disposed within the salt water environment, wherein the elongate tubular housing includes a proximal end and a distal end;

a probe for targeting the soft tissue organism, the probe protruding from the distal end of the housing, wherein the probe is exposed to the salt water environment when the distal end is submerged therein; and a conductive element comprising an elongate rod having a lengthwise extent and two opposed ends rigidly supported by and surrounded by the housing between the distal end and the proximal end, such that an intermediate portion of the conductive element being exposed to the salt water environment when the housing distal end is submerged therein, the probe and the conductive element being operatively coupled to a source of electric current, such that the salt water environment provides a circuit coupling between the probe and the conductive element for killing the soft tissue organism.

2. The apparatus of claim 1, further comprising:

a switch controlling the electric current, the switch disposed closer to the housing proximal end than the housing distal end.

3. The apparatus of claim 1, wherein the conductive element is graphite.

4. The apparatus of claim 3, wherein the conductive element is operatively coupled to the source of electric current by way of a coil element joining the conductive element to an electrical wire.

5. The apparatus of claim 1, wherein the conductive element is spaced away from the probe toward the housing proximal end.

6. The apparatus of claim 1, wherein the elongate tubular housing substantially resists deformation from a weight of a distal portion of the apparatus when held at a proximal portion of the apparatus as the primary support for the distal portion, the apparatus distal portion corresponding to the housing distal end and the apparatus proximal portion corresponding to the housing proximal end.

7. The apparatus of claim 1, wherein at least a portion of the conductive element is surrounded by the housing.

8. The apparatus of claim 1, wherein the conductive element is at least partially contained within a secondary structure secured to and protruding laterally from the housing.

9. The apparatus of claim 8, wherein the conductive element protrudes outwardly from the secondary housing and into a tertiary housing secured to and protruding laterally from the housing.

10. The apparatus of claim 1, wherein the conductive element is disposed within a portion of the elongate tubular housing, the elongate tubular housing including apertures immediately adjacent the conductive element thereby exposing the conductive element to the salt water environment when the distal portion is submerged therein.

11. The apparatus of claim 10, wherein the conductive element includes a hollow inner portion through which a wire passes for coupling the source of electric current with the probe.

12. The apparatus of claim 1, wherein the portion of the elongate tubular housing in which the conductive element is disposed bulges wider than the substantial extent of the tubular housing.

13. The apparatus of claim 1, wherein a substantial extend of the elongate tubular housing is straight and a portion of the distal end of the elongate tubular housing includes a bend for precisely positioning the probe in the salt water environment.

14. The apparatus of claim 13, wherein the bend is disposed along the length of the elongate tubular housing between the conductive element and the probe.

* * * * *